US007414456B2

(12) United States Patent
Bowers

(10) Patent No.: US 7,414,456 B2
(45) Date of Patent: Aug. 19, 2008

(54) CONSTANT RATIO CURRENT SOURCE

(75) Inventor: Derek Bowers, Los Altos Hills, CA (US)

(73) Assignee: Analog Devices, Inc., Norwood, MA (US)

( * ) Notice: Subject to any disclaimer, the term of this patent is extended or adjusted under 35 U.S.C. 154(b) by 0 days.

(21) Appl. No.: 11/465,430

(22) Filed: Aug. 17, 2006

(65) Prior Publication Data

US 2008/0042732 A1 Feb. 21, 2008

(51) Int. Cl.
*G05F 1/10* (2006.01)

(52) U.S. Cl. ..... 327/538; 330/252

(58) Field of Classification Search ..... 327/538, 327/543; 330/252, 257

See application file for complete search history.

(56) References Cited

U.S. PATENT DOCUMENTS 4,769,617 A * 9/1988 Mizuide ..... 330/260
4,904,952 A * 2/1990 Tanimoto ..... 330/252
5,587,689 A * 12/1996 Bowers ..... 330/254
6,229,394 B1 * 5/2001 Harvey ..... 330/252
6,667,654 B2 * 12/2003 Behzad et al. ..... 327/543

* cited by examiner

*Primary Examiner*—Jeffrey S Zweizig
(74) *Attorney, Agent, or Firm*—Koppel, Patrick, Heybl & Dawson

(57) ABSTRACT

A constant ratio current source comprises a first current branch which includes a first transistor that conducts a current I1 from a first current input to a first node and a resistor R1 connected between the first node and a circuit common point, and a second current branch which includes a second transistor that conducts a current I2 from a second current input to a second node and a resistor R2 connected between the second node and the circuit common point. The current branches are arranged such that I2 varies with I1. A linear negative resistance circuit connected between the first and second nodes provides an apparent negative resistance that increases the differential output impedance at the first and second current inputs, such that the ratio of I2:I1 is maintained approximately constant for a varying differential voltage applied across the first and second current inputs.

6 Claims, 6 Drawing Sheets

CONSTANT RATIO CURRENT SOURCE

BACKGROUND OF THE INVENTION

1. Field of the Invention

This invention relates to current sources, and particularly to current sources capable of providing a second current in a constant ratio to a first current.

2. Description of the Related Art

There are many circuit applications in which a second current is needed which is in a constant ratio to a first current. Circuits which provide currents that compensate for the base currents of a differential input stage typically require the generation of a second current that varies with the input stage's tail current. If the second current closely tracks the tail current, it can be used to provide compensation currents which substantially reduce the stage's input currents.

Difficulties can arise when there is a differential voltage between the first and second current sources. For example, one way in which ratioed currents can be generated is shown in FIG. 1*a*. First and second transistors Qa and Qb have their emitters connected to a circuit common point and their bases connected to a common bias voltage. When so arranged, Qa and Qb conduct currents I1 and I2, respectively, with:

$$\frac{I1}{I2} \propto 1 + \left(\frac{V_{diff}}{V_A}\right),$$

where $V_{diff}$ is the differential voltage between the two collectors, and $V_A$ is the Early voltage. As the current ratio varies significantly with $V_{diff}$, this approach is unacceptable for many applications in the differential voltage is likely to vary.

The performance of the circuit of FIG. 1*a* can be improved by the addition of degeneration resistors Ra and Rb in the emitter circuits of Qa and Qb, as shown in FIG. 1*b*. When so configured:

$$\frac{I1}{I2} \propto 1 + \left(\frac{V_{diff}}{V_A} * \frac{\frac{kT}{q}}{V_{deg} + \frac{kT}{q}}\right),$$

where $V_{deg}$ is the voltage across the degeneration resistors. Here, the variation of the current ratio with $V_{diff}$ is significantly reduced, but the addition of Ra and Rb results in the circuit requiring additional headroom.

Another way to improve the performance of the circuit of FIG. 1*a* is to provide cascode transistors for Qa and Qb; this is shown in FIG. 1*c*. Here, assuming that all the transistors have equal beta (β) values:

$$\frac{I1}{I2} \propto 1 + \left(\frac{V_{diff}}{\beta * V_A}\right).$$

This approach also reduces the variation of current ratio with $V_{diff}$, but at the expense of additional headroom and an extra bias voltage generator.

A basic current mirror can also be used to generate a second current which is proportional to a first current. However, since the output impedance of each mirror transistor is proportional to its Early voltage divided by its collector current, the mirror's output impedance will be low—causing the current ratio to vary significantly with $V_{diff}$. This can be improved by adding emitter degeneration resistors Ra and Rb as shown in FIG. 1*d*, but as with the circuit of FIG. 1*b*, the addition of Ra and Rb results in the circuit requiring additional headroom.

Another way to improve the performance of the current mirror of FIG. 1*d* is to add a negative resistance circuit 10 as shown in FIG. 1*e*; such an arrangement is described, for example, in U.S. Pat. No. 5,587,689 to Bowers. In this configuration, emitter-coupled transistors Qc and Qd are cross-coupled, with the base of Qc and the collector of Qd connected to the emitter of Qa, and the base of Qd and the collector of Qc connected to the emitter of Qb. This arrangement creates an apparent negative resistance which acts to increase the effective resistance of emitter resistors Ra and Rb, and thereby increase the mirror's output impedance such that the variation of the I2:I1 ratio with $V_{diff}$ is reduced. However, non-linearities associated with Qc and Qd render the negative resistance circuit of FIG. 1*e* nonlinear and poorly controlled, thereby degrading the accuracy of the I2:I1 ratio.

SUMMARY OF THE INVENTION

A constant ratio current source is presented which overcomes the problems noted above, providing a current ratio which is nearly constant with differential voltage, without requiring extra headroom.

The present constant ratio current source comprises a first current branch which includes a first transistor that conducts a current I1 from a first current input to a first node and a resistor R1 connected between the first node and a circuit common point, and a second current branch which includes a second transistor that conducts a current I2 from a second current input to a second node and a resistor R2 connected between the second node and the circuit common point. The first and second current branches are arranged such that current I2 varies with current I1. The current source also requires a linear negative resistance circuit connected between the first and second nodes, which provides an apparent negative resistance that increases the differential output impedance at the first and second current inputs such that the ratio of I2:I1 is maintained approximately constant for a varying differential voltage applied across the first and second current inputs.

The present current source is easily configured to provide a nearly constant I2:I1 ratio of 1:1, or ratios other than 1:1. The current source is useful in many applications, such as a bias current compensation circuit as discussed above.

Further features and advantages of the invention will be apparent to those skilled in the art from the following detailed description, taken together with the accompanying drawings.

DETAILED DESCRIPTION OF THE INVENTION

Figure 1A:
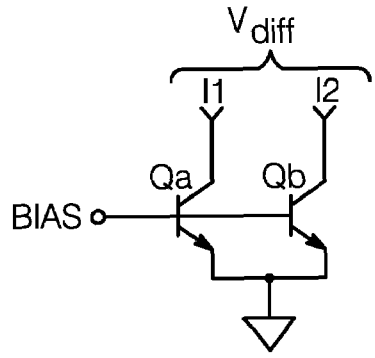
FIG.1a (Prior Art)
FIGS. 1*a*-1*e* are schematic diagrams of known current sources.
Figure 1B:
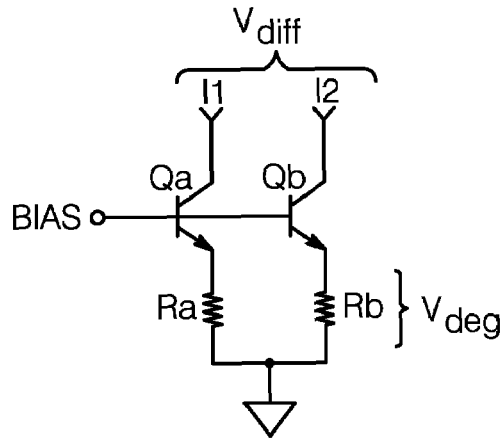
FIG.1b (Prior Art)
Figure 1C:
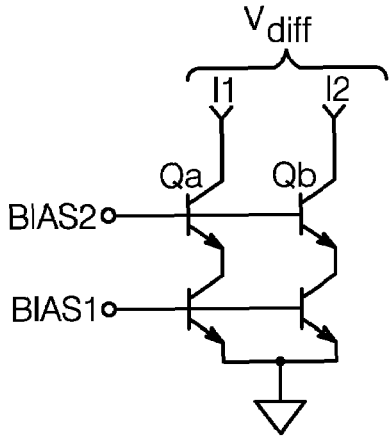
FIG.1c (Prior Art)
Figure 1D:
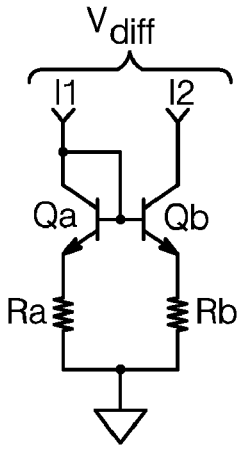
FIG.1d (Prior Art)
Figure 1E:
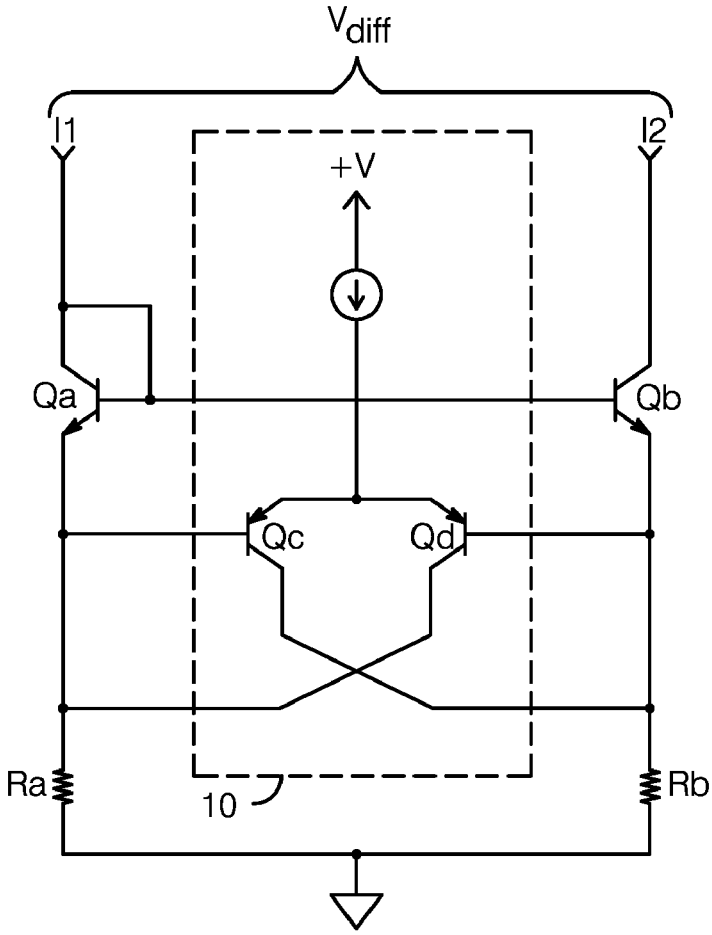
FIG.1e (Prior Art)
Figure 2:
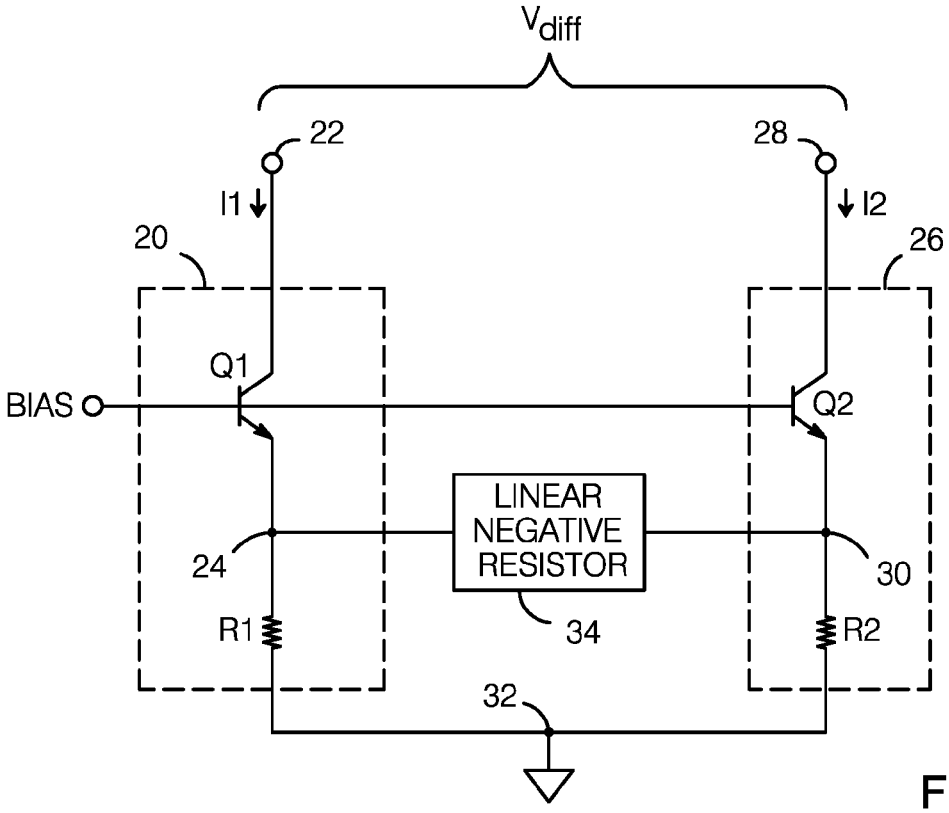
FIG. 2 is a block/schematic diagram illustrating the basic principles of a constant ratio current source per the present invention.

The basic principles of a constant ratio current source per the present invention are illustrated in FIG. 2. The current source includes a first current branch 20 comprising a transistor Q1 which conducts a current I1 from a first current input 22 to a first node 24 and a resistor R1 connected between node 24 and a circuit common point 32, and a second current branch 26 comprising a transistor Q2 which conducts a current I2 from a second current input 28 to a second node 30 and a resistor R2 connected between node 30 and circuit common point 32. First and second current branches 20 and 26 are arranged such that current I2 varies with current I1; in FIG. 2, this is accomplished by coupling the emitters and bases of Q1 and Q2 together and driving both transistors with a common voltage (BIAS), though other circuit configurations could also be used.

The current source also includes a linear negative resistance circuit 34 connected between nodes 24 and 30. The linear negative resistance provides an apparent negative resistance, which acts to increase the effective resistance of emitter resistors R1 and R2, and thereby increase the current source's output impedance, such that the variation of the I2:I1 ratio with differential voltage that would occur in the absence of linear negative resistance circuit 34 is reduced. Furthermore, the negative resistance circuit is arranged such that its apparent negative resistance varies linearly with the difference voltage between nodes 24 and 30. This enables the ratio of I2:I1 to be maintained approximately constant for a varying differential voltage ($V_{diff}$) applied across first and second current inputs 22 and 24, without requiring any additional headroom.

Figure 3:
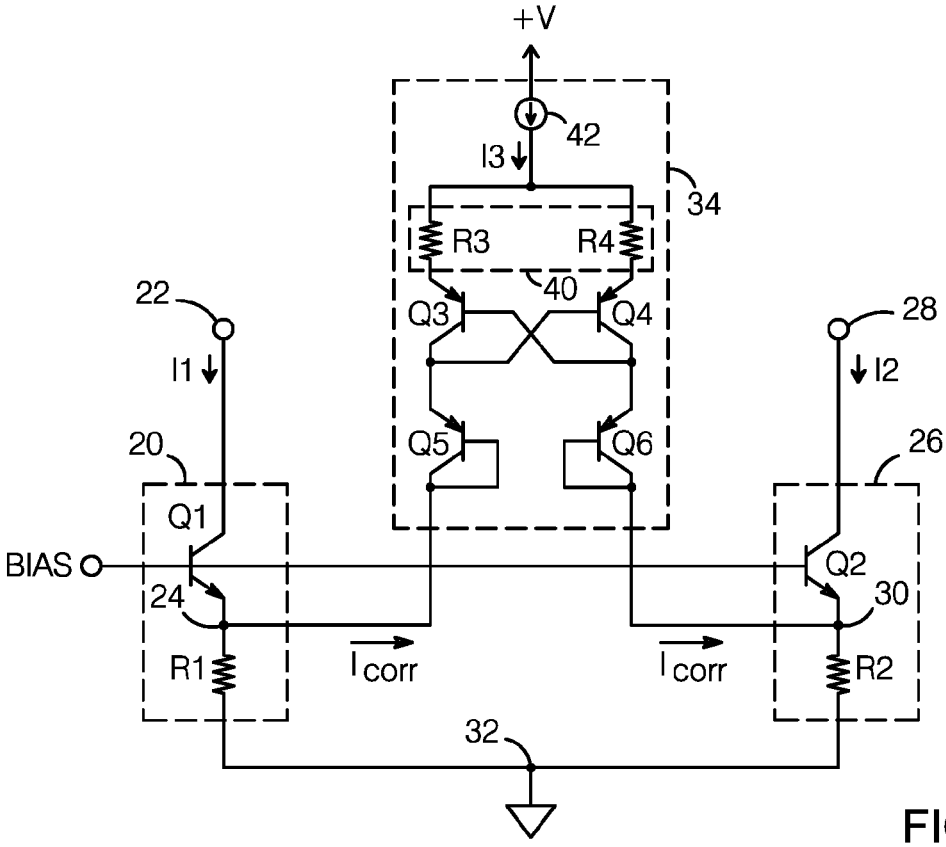
FIG. 3 is a schematic diagram of one possible embodiment of a constant ratio current source per the present invention.

Linear negative resistance circuit 34 could be implemented in many different ways; one possible embodiment is shown in FIG. 3. Circuit 34 includes cross-coupled transistors Q3 and Q4, such that the bases of Q3 and Q4 are connected to the collectors of Q4 and Q3, respectively, and are coupled to nodes 30 and 24, respectively. When so arranged, the voltage between the emitters of Q3 and Q4 has a polarity opposite that of differential voltage $V_{diff}$ present across first and second current inputs 22 and 28. A resistance circuit 40 is connected between the emitters of cross-coupled transistors Q3 and Q4, and a current source 42 is connected such that it supplies a bias current I3 that flows to nodes 30 and 24 via resistance circuit 40 and cross-coupled transistors Q3 and Q4.

When so arranged, cross-coupled transistors Q3 and Q4 respond to changes in $V_{diff}$ by dividing bias current I3 between Q3 and Q4 to produce a differential correction current ($I_{corr}$) that maintains the ratio of I2:I1 approximately constant.

In one embodiment, a diode-connected transistor Q5 is connected in series between Q3 and node 24, and a diode-connected transistor Q6 is connected in series between Q4 and node 30. Resistance circuit 40 comprises a resistor R3 connected between the emitter of Q3 and current source 42, and a resistor R4 connected between the emitter of Q4 and current source 42. When R1=R2=R3=R4=R, and neglecting base currents:

$$I_c(Q3)=I_c(Q5) \quad \text{(Eq. 1)}$$

$$I_c(Q4)=I_c(Q6) \quad \text{(Eq. 2)}$$

$$V_{be}(Q3)=V_{be}(Q5) \quad \text{(Eq. 3)}$$

$$V_{be}(Q4)=V_{be}(Q6) \quad \text{(Eq. 4)}$$

where $I_c$ refers to collector current flowing through a particular transistor and $V_{be}$ refers to the base-emitter voltage of a particular transistor.

The voltages at the emitters of transistors Q3 and Q4 are given by:

$$V_e(Q3)=V_{30}-V_{be}(Q6)-V_{be}(Q3) \quad \text{(Eq. 5)}$$

and $$V_e(Q4)=V_{24}-V_{be}(Q5)-V_{be}(Q4) \quad \text{(Eq. 6)}$$

where $V_{30}$ and $V_{24}$ are the voltages at nodes 30 and 24, respectively.

The voltage across emitter resistor R3 ($V_e$(Q3)) and emitter resistor R4 ($V_e$(Q4)) is found by subtracting equation 5 from equation 6 and substituting the relationships in equations 1-4, such that:

$$V_e(Q4)-V_e(Q3)=V_{24}-V_{30} \quad \text{(Eq. 7)}$$

Thus, the polarity of the differential voltage $V_e$(Q4)−$V_e$(Q3) has been effectively reversed, so that viewed from nodes 24 and 30 the resistance of negative resistance circuit 34 appears to be −2R.

The total differential current in negative resistance circuit 34 is characterized by:

$$I_c(Q6)-I_c(Q5)=2I_{corr}=\frac{V_e(Q4)-V_e(Q3)}{R} \quad \text{(Eq. 8)}$$

Substituting equation 7 and solving for $I_{corr}$ gives:

$$I_{corr}=\frac{V_{30}-V_{24}}{-2R}$$

where $I_{corr}$ is the correction current produced by linear negative resistance 34, which is added to I2 and subtracted from I1 as needed to maintain the ratio of I2:I1 approximately constant.

Bias current I3 reduces the magnitude of values of I1 and I2, and can potentially create an error in these currents. However, this error can be compensated for by adjusting the value of bias voltage BIAS such that I1 and I2 are increased by an amount equal to the magnitude of I3. The magnitude of I3 should not be so large as to require a substantial increase in BIAS, as this increases the circuit's power consumption. However, if I3 is too small, transistors Q1 and Q2 may be cut off. I3 should be selected such that $$I3 \geq \frac{(V_{24}-V_{30})_{\max}}{R},$$

where $(V_{24}-V_{30})_{max}$ is the maximum possible difference voltage between nodes 24 and 30.

Figure 4:
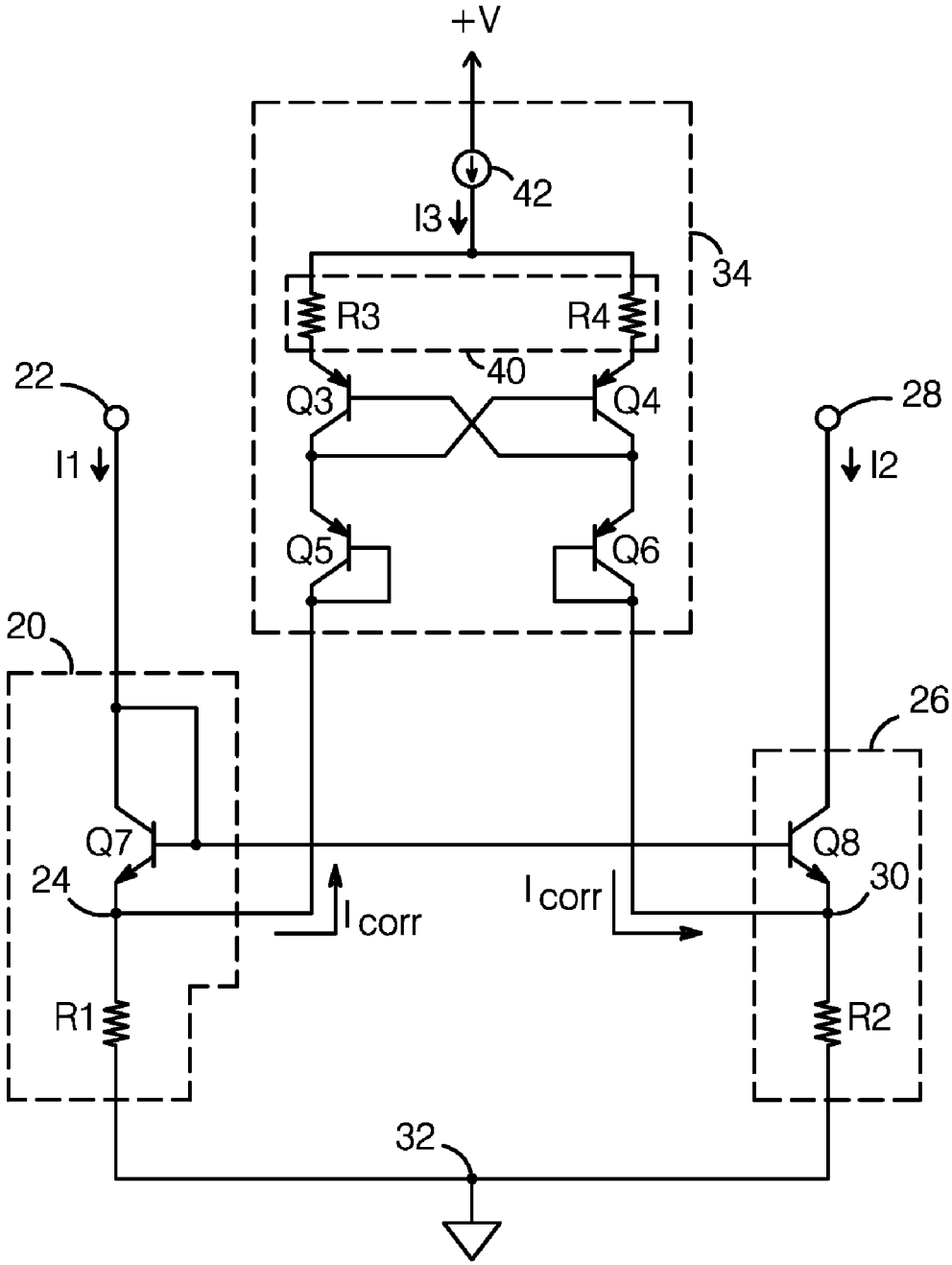
FIG. 4 is a schematic diagram of another possible embodiment of a constant ratio current source per the present invention.

Another possible embodiment of a constant ratio current source in accordance with the present invention is shown in FIG. 4. Here, first current branch 20 comprises a diode-connected transistor Q7 which conducts current I1 between first current input 22 and node 24; as above, emitter resistor R1 is connected between node 24 and circuit common point 32. Second current branch 26 comprises a transistor Q8 connected to form a current mirror with Q7 such that it conducts current I2 from second current input 28 to second node 30; emitter resistor R2 is connected between node 30 and circuit common point 32. As above, linear negative resistance circuit 34 is connected between nodes 24 and 30, and acts to increase the effective resistance of the emitter resistors and thereby increase the mirror's output impedance, such that the variation of the I2:I1 ratio with differential voltage is reduced. Furthermore, the apparent negative resistance varies linearly with the difference voltage between nodes 24 and 30, such that the I2:I1 ratio is maintained approximately constant for a varying differential voltage ($V_{diff}$) applied across first and second current inputs 22 and 24, without requiring any additional headroom.

When the ratio of I1 to I2 is to be 1:1 and the linear negative resistance circuit is implemented as shown in FIGS. 3 and 4, resistors R1, R2, R3 and R4 are preferably all made equal, as are the sizes of Q3-Q6. Current ratios other than 1:1 can also be obtained, by making R1≠R2, with the ratio of I1:I2 being approximately proportional to the ratio of R2:R1. In this case, to ensure that I3 is correctly apportioned, R3 and R4 should be skewed to match the ratio of R1:R2. Thus, if R1≠R2, making R3=R1 and R4=R2 will provide the correct apportionment.

Figure 5:
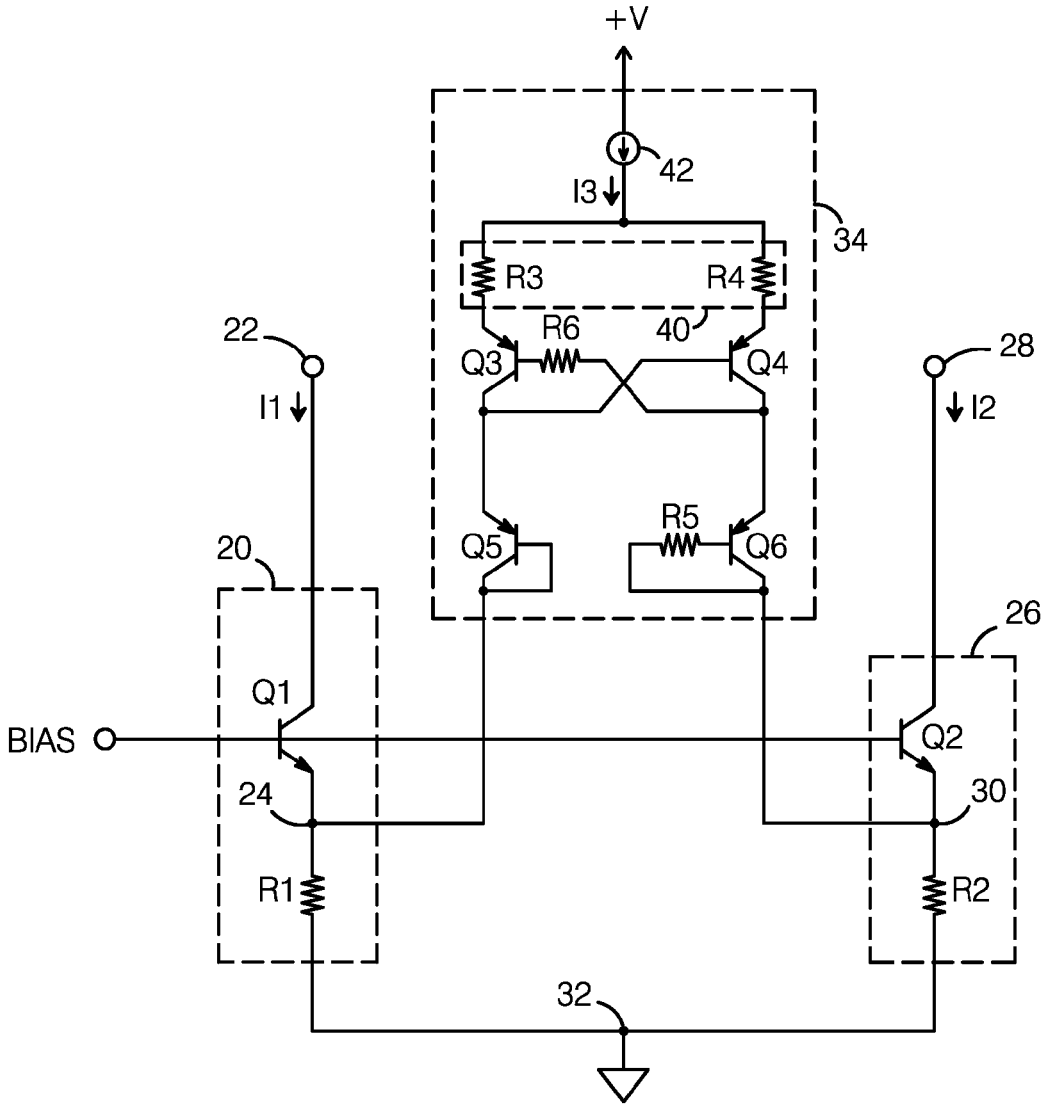
FIG. 5 is a schematic diagram of another possible embodiment of a constant ratio current source per the present invention.

However, using unequal resistors in this way also gives rise to an error in the I1:I2 ratio due to Q3 and Q4 having unequal base currents. This error can be compensated for by adding a resistor (R5) to the base circuit of Q6, and/or to the base circuit of Q3 (R6), as shown in FIG. 5. When R5 is added, it should be sized such that:

$$R5 = \left(1 - \frac{R4}{R3}\right)(R3 + R4).$$

If a resistor R6 is also added, it should be sized such that:

$$R6 = \left(\frac{R3}{R4}\right)(R5).$$

Adding these resistors will equalize the base currents of Q3 and Q4, and thereby substantially reduce the error that might otherwise arise when I1≠I2. The formulas above assume that R3 and R4 are large, and that I2>I1.

Figure 6:
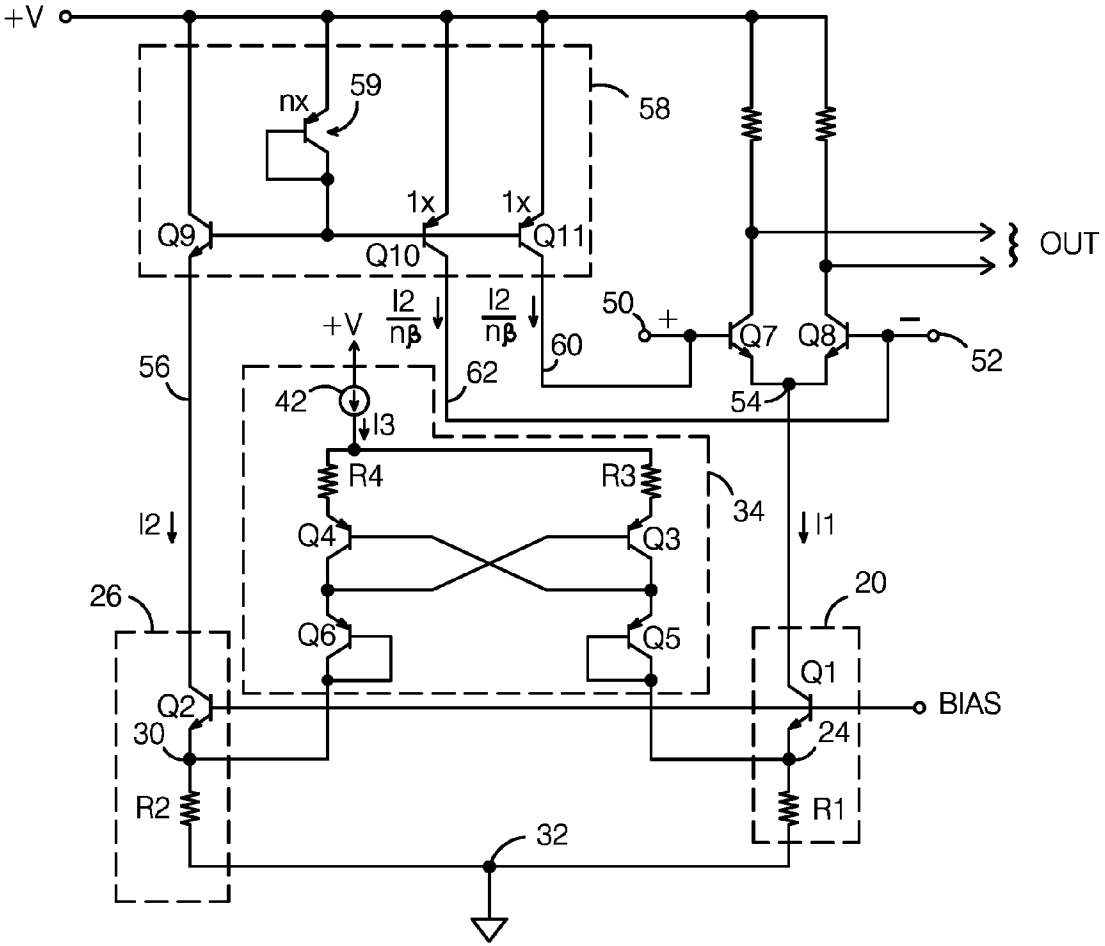
FIG. 6 is a schematic diagram of a bias current compensation circuit which includes the present constant ratio current source.

One possible application of a constant ratio current source as described herein is in a bias current compensation circuit for a differential amplifier; one possible embodiment is shown in FIG. 6. The differential amplifier comprises a differential pair Q7 and Q8, which receives a differential input voltage at its base terminals 50 and 52, and the emitters of which are connected together at a common emitter node 54. The present constant ratio current source is connected to emitter node 54 such that its current I1 is the differential pair's tail current. The pair transistors have respective base currents; when the voltages applied to base terminals 50 and 52 are equal, the base currents are given by $$\frac{I1}{2\beta_{Q7}} \text{ and } \frac{I1}{2\beta_{Q8}},$$

where $\beta_{Q7}$ and $\beta_{Q8}$ are the beta values for Q7 and Q8, respectively.

Ideally, the net currents into base terminals 50 and 52 are zero. One way of accomplishing this is to replicate tail current I1, and to mirror the replicated current back to base terminals 50 and 52 as needed to compensate for the base currents. A constant ratio current source per the present invention is suitably employed to replicate the tail current. Thus, in FIG. 6, the constant ratio current source comprises first current branch 20, connected between common emitter node 54 and circuit common point 32 such that its transistor Q1 conducts I1, second current branch 26 connected between a node 56 and circuit common point 32 such that its transistor Q2 conducts I2, and linear negative resistance circuit 34 connected between nodes 24 and 30. When arranged as discussed above, current I2 is maintained in a constant ratio to I1.

The bias current compensation circuit also includes a current mirroring circuit 58, which receives I2 and is arranged to provide first and second output currents 60 and 62 to the bases of Q7 and Q8, respectively. Current mirroring circuit 58 could be implemented in numerous ways; when arranged as shown in FIG. 6, a "dummy" input transistor Q9 having the same characteristics as Q7 and Q8 is connected to conduct I2, and a diode 59 (preferably a diode-connected PNP, as shown) D1 and transistors Q10 and Q11 are connected so as to produce output currents 60 and 62, each of which is given by $$\frac{I2}{n\beta_{Q9}},$$

at their respective emitters. Then, assuming $\beta_{Q7}=\beta_{Q8}=\beta_{Q9}$, if $$\frac{I2}{n} = \frac{I1}{2},$$

the net currents into base terminals 50 and 52 will be approximately zero, as long as the ratio of I1 and I2 remain approximately constant as provided by the present constant ratio current source.

Note that the bias current compensation circuit implementation shown in FIG. 6 is merely exemplary; there are many ways in which the present constant ratio current source could be used to provide the necessary compensation currents. Also note that a bias current compensation circuit is but one possible application of the present invention, which would be useful whenever there is a need for two currents in a constant ratio.

While particular embodiments of the invention have been shown and described, numerous variations and alternate embodiments will occur to those skilled in the art. Accordingly, it is intended that the invention be limited only in terms of the appended claims.

I claim:

1. A constant ratio current source, comprising:

a first current branch comprising:

a transistor Q1 which conducts a current I1 from a first current input to a first node; and a resistor R1 connected between said first node and a circuit common point;

a second current branch comprising:

a transistor Q2 which conducts a current I2 from a second current input to a second node; and a resistor R2 connected between said second node and said circuit common point, said first and second current branches arranged such that I2 varies with I1;

a linear negative resistance circuit connected between said first and second nodes and arranged to provide an apparent negative resistance which increases the differential output impedance at said first and second current inputs such that the ratio of I2:I1 is maintained approximately constant for a varying differential voltage applied across said first and second current inputs, wherein said linear negative resistance circuit comprises:

a third transistor Q3;

a fourth transistor Q4, Q3 and Q4 being cross-coupled transistors having respective bases, collectors and emitters, such that the bases of Q3 and Q4 are connected to the collectors of Q4 and Q3 and are coupled to said second and first nodes, respectively, such that the voltage between the emitters of Q3 and Q4 has a polarity opposite that of the differential voltage present across said first and second differential current inputs;

a resistance circuit connected between the emitters of said cross-coupled transistors; and a first current source which supplies a bias current I3 that flows through said resistance circuit and said cross-coupled transistors, wherein said resistance circuit comprises:

a resistor R3 connected between the emitter of Q3 and said first current source; and a resistor R4 connected between the emitter of Q4 and said first current source, R1-R4 arranged such that R1≃R3, R2≃R4, R1≠R2, and I1≠I2;

said cross-coupled pair of transistors responding to changes in said differential voltage by dividing I3 between said cross-coupled transistors to produce a differential correction current that maintains said ratio of I2:I1 approximately constant for a varying differential voltage across said first and second current inputs;

a fifth transistor Q5 which is diode-connected and connected between the collector of Q3 and said first node;

a sixth transistor Q6 which is diode-connected and connected between the collector of Q4 and said second node; and a resistor R5 connected in series between the collector and base of Q6 and sized such that:

$$R5 = \left(1 - \frac{R4}{R3}\right)(R3 + R4).$$

2. The constant ratio current source of claim 1, further comprising:

a resistor R6 connected in series between the base of Q3 and the collector of Q4 and sized such that:

$$R6 = \left(\frac{R3}{R4}\right)(R5).$$

3. The constant ratio current source of claim 1, further comprising a bias voltage connected to drive both Q1 and Q2.

4. The constant ratio current source of claim 1, wherein said transistor Q1 is diode-connected and the control inputs of Q1 and Q2 are connected together such that Q1 and Q2 form a current mirror which mirrors said I1 current from said first current input to said second current input.

5. A differential amplifier with a bias current compensation circuit, comprising:

a bipolar differential pair, the emitters of said pair connected together at a common emitter node, said pair transistors having respective base currents;

a constant ratio current source, comprising:

a first current branch comprising:

a transistor Q1 which conducts a current I1 from a first current input to a first node; and a resistor R1 connected between said first node and a circuit common point, said first current input coupled to said common emitter node such that said pair's tail current is I1;

a second current branch comprising:

a transistor Q2 which conducts a current I2 from a second current input to a second node; and a resistor R2 connected between said second node and said circuit common point, said first and second current branches arranged such that current I2 varies with current I1; and a linear negative resistance circuit connected between said first and second nodes and arranged to provide an apparent negative resistance which increases the differential output impedance at said first and second current inputs such that the ratio of I2:I1 is maintained approximately constant for a varying differential voltage applied across said first and second current inputs; and a current mirroring circuit which is coupled to said second current input at an input and is arranged to provide first and second output currents to respective bases of said pair transistors, said constant ratio current source and said current mirroring circuit arranged such that said first and second output currents make the net base currents of each of said pair transistors approximately equal to zero.

6. The amplifier of claim 5, wherein said linear negative resistance circuit comprises:

a third transistor Q3;

a fourth transistor Q4;

a fifth transistor Q5, Q5 being diode-connected;

a sixth transistor Q6, Q6 being diode-connected;

Q3 and Q4 being cross-coupled transistors having respective bases, collectors and emitters, such that the bases of Q3 and Q4 are connected to the collectors of Q4 and Q3 and are coupled to said second and first nodes via Q6 and Q5, respectively, such that the voltage between the emitters of Q3 and Q4 has a polarity opposite that of the differential voltage present across said first and second differential current inputs;

a resistor R3 connected between the emitter of Q3 and a third node;

a resistor R4 connected between the emitter of Q4 and said third node; and a first current source coupled to said third node which supplies a bias current I3 which flows through said cross-coupled transistors via R3 and R4;

said cross-coupled pair of transistors responding to changes in said differential voltage by dividing I3 between said cross-coupled transistors to produce a differential correction current that maintains the ratio of I2:I1 approximately constant for a varying differential voltage across said first and second current inputs.

* * * * *